US010372056B2

(12) United States Patent
Fujiwara et al.

(10) Patent No.: US 10,372,056 B2
(45) Date of Patent: Aug. 6, 2019

(54) IMAGE FORMING APPARATUS HAVING GRID ELECTRODE WITH OPENING AND NON-OPENING PORTIONS

(71) Applicant: CANON KABUSHIKI KAISHA, Tokyo (JP)

(72) Inventors: Motohiro Fujiwara, Düsseldorf (DE); Kunihiko Kitayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/964,897

(22) Filed: Apr. 27, 2018

(65) Prior Publication Data

US 2018/0314181 A1 Nov. 1, 2018

(30) Foreign Application Priority Data

Apr. 28, 2017 (JP) ..... 2017-090615

(51) Int. Cl.
*G03G 15/02* (2006.01)

(52) U.S. Cl.
CPC ... *G03G 15/0291* (2013.01); *G03G 2215/027* (2013.01)

(58) Field of Classification Search
CPC ..... G03G 15/0291
USPC ..... 399/171
See application file for complete search history.

(56) References Cited

U.S. PATENT DOCUMENTS 5,025,155 A 6/1991 Hattori
7,738,813 B2 * 6/2010 Yasutomi et al. ..... G03G 15/0291 399/171
8,538,296 B2 * 9/2013 Ogasawara et al. ..... G03G 15/0291 399/171
9,778,590 B2 10/2017 Nishimura et al.

FOREIGN PATENT DOCUMENTS

JP 59-171970 A 9/1984
JP 01-232369 A 9/1989
JP 07-271149 A 10/1995
JP 11-305518 A 11/1999
JP 2007-264219 A 10/2007
JP 2016-103000 A 6/2016

* cited by examiner

*Primary Examiner* — William J Royer
(74) *Attorney, Agent, or Firm* — Venable LLP

(57) ABSTRACT

An image forming apparatus includes a corona charger including a discharging wire and a grid electrode for charging a photosensitive drum at a charging position and an exposure device for exposing the drum charged by the charger at an exposure position which is at a downstream side of the charger (in a rotational direction of the drum) at the charging position. The grid electrode includes a first portion having openings and a second portion having only a non-opening portion in a charging region for charging the drum in a longitudinal direction of the charger, and the second portion includes a downstream side peripheral portion at a downstream end of the grid electrode with respect to the rotational direction. In a cross-section orthogonal to (Continued)

the longitudinal direction and including the charging region, the downstream side peripheral portion is intersected by a straight line passing through the exposure position and the wire.

7 Claims, 6 Drawing Sheets

(a)

(b)

IMAGE FORMING APPARATUS HAVING GRID ELECTRODE WITH OPENING AND NON-OPENING PORTIONS

FIELD OF THE INVENTION AND RELATED ART

The present invention relates to an image forming apparatus which uses an electrophotographic image forming method, an electrophotographic recording method, or the like, and which has a corona-based charging device for charging an image bearing member to form an electrostatic image on the image bearing member.

In the field of an electrophotographic image forming apparatus, a corona-based charging device (which hereafter may be referred to simply as "charging device") has been widely used as a charging means for charging an electrophotographic photosensitive member (photosensitive member) as an image bearing member. In recent years, it has been increasingly desired to increase an electrophotographic image forming apparatus or the like in the speed with which the apparatus outputs images. Thus, it has been increasingly desired to increase the apparatus in the peripheral velocity of its photosensitive member, and/or to employ a photosensitive member which is substantially larger in electrostatic capacity. Therefore, it has been increasingly desired to improve a charging device in charging performance. Moreover, it has also been increasingly desired to reduce an electrophotographic image forming apparatus or the like in size.

Thus, it has become necessary to deal with the following issues which a corona-based charging device suffers:

To begin with, as a charging device is improved in charging performance, a given point of the peripheral surface of a photosensitive member keeps on increasing in surface potential level in terms of absolute value, during the period from when the given point begins to move through the charging area in which a charging device faces the peripheral surface of the photosensitive member to when it moves out of the charging area. Thus, the potential level of the photosensitive member is unlikely to converge to a desired value. Therefore, it is likely that a photosensitive member becomes nonuniformly charged, since it is possible that the photosensitive layer of a photosensitive member may not be perfectly uniform in thickness, and/or a charging device may not be perfectly positioned.

In addition, as a charging device is increased in size for the improvement of its charging performance, the space available in the adjacencies of the peripheral surface of a photosensitive member is likely to be reduced, which in turn is likely to reduce the distance, in terms of the rotational direction of the photosensitive member, between the charging device and a given point on the peripheral surface of the photosensitive member, which is to be charged by the charging device at a given point in time. Further, it is likely that the area (range) in which the charging device can charge the peripheral surface of a photosensitive member might extend beyond the preset range in the downstream direction. If the charging area extends beyond the preset range, a given point of the peripheral surface of the photosensitive member may continue to be charged even after it is exposed at a preset exposing position, and therefore, it is likely for the exposed point (area) to be changed in potential level from a preset one. Moreover, it is sometimes required to reduce the distance between a charging device and the exposing point, in order to reduce an image forming apparatus in size.

Thus, it has been proposed in Japanese Laid-open Patent Application No. H11-305518 to attach a piece of Mylar film to the exposing position side of the bottom portion of the casing of the charging device, in contact with the grid electrode of a charging device, in order to prevent ions from flowing to the exposing position, through the gap between the grid electrode and casing.

Further, it has been proposed in Japanese Laid-open Patent Application No. H07-271,149 to place the grid electrode of a charging device, in contact with the shield (casing) of the charging device, by extending the bottom portion of the exposing position side of the shield (casing), in order to prevent ions from flowing to the exposing position through the gap between the grid electrode and shield (casing).

However, the structures proposed in the abovementioned patent documents 1 and 2 do not address the issue, described above, that the surface potential of the photosensitive member of an electrophotographic image forming apparatus or the like is likely to fail to converge to a desired level.

SUMMARY OF THE INVENTION

According to an aspect of the present invention, there is provided an image forming apparatus comprising a rotatable photosensitive member; a corona charger including a discharging wire and a plate-like grid electrode and configured to charge a surface of said photosensitive member at a charging position; and an exposure device configured to expose the surface of said photosensitive member charged by said corona charger at an exposure position which is in a downstream side of said corona charger in a rotational direction of said photosensitive member at the charging position to form an electrostatic image, wherein said grid electrode includes a first portion having a plurality of openings and a second portion having only a non-opening portion in a charging region for charging said photosensitive member with respect to a longitudinal direction of said corona charger, and the second portion includes a downstream side peripheral portion at a downstream end of said grid electrode with respect to the rotational direction, and wherein in a cross-section orthogonal to the longitudinal direction and including the charging region, the downstream side peripheral portion is intersected by a straight line A passing through the exposure position and said discharging wire.

Further features of the present invention will become apparent from the following description of exemplary embodiments with reference to the attached drawings.

Figure 6:
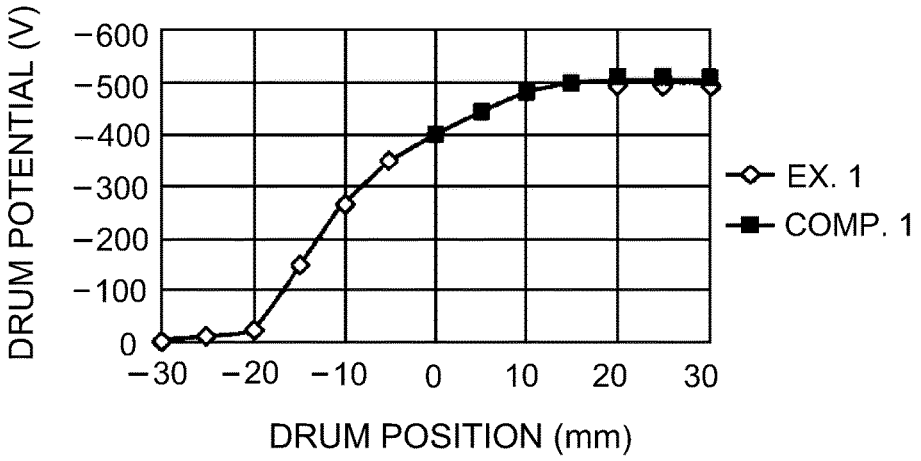
Figure 6:
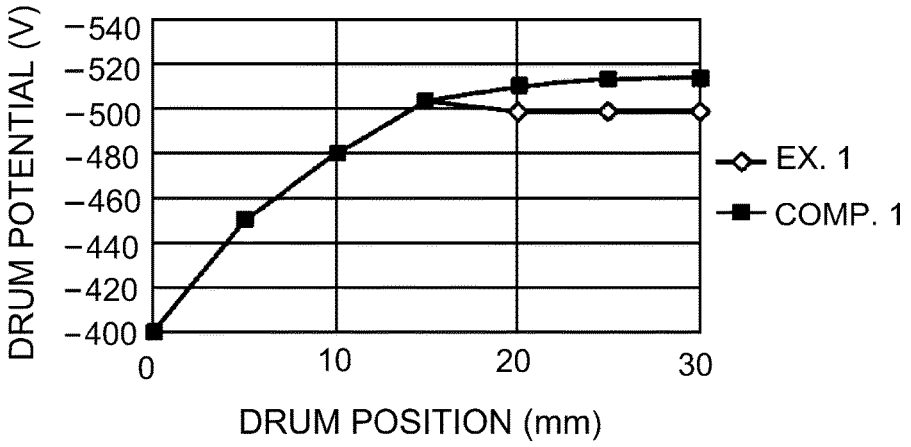

Parts (a) and (b) of FIG. 6 are graphs which show the relationship between the distance from the charging position to a given point of the peripheral surface of the photosensitive member, and the potential level of the given point.

Figure 7:
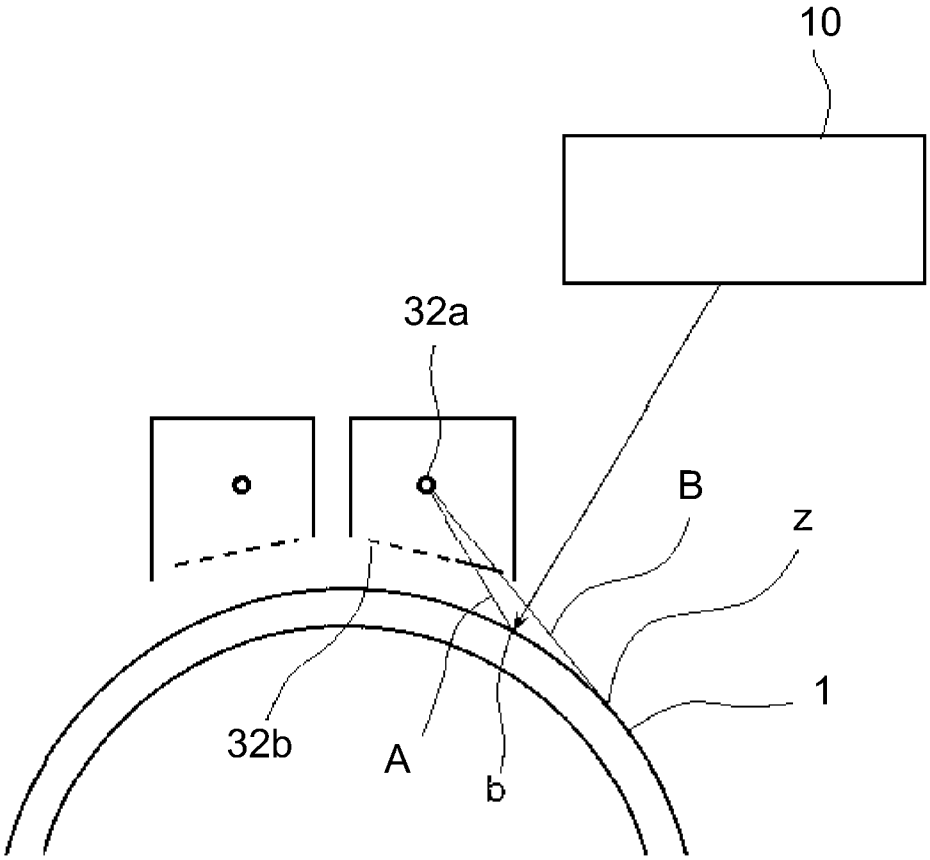

FIG. 7 is a schematic sectional view of a combination of the charging device, and the portion of the photosensitive member, which is opposing the charging device; it is for describing the portion of the grid electrode, which is for causing the potential of (given point of) the peripheral surface of the photosensitive member to converge to a desired (preset) level.

Figure 8:
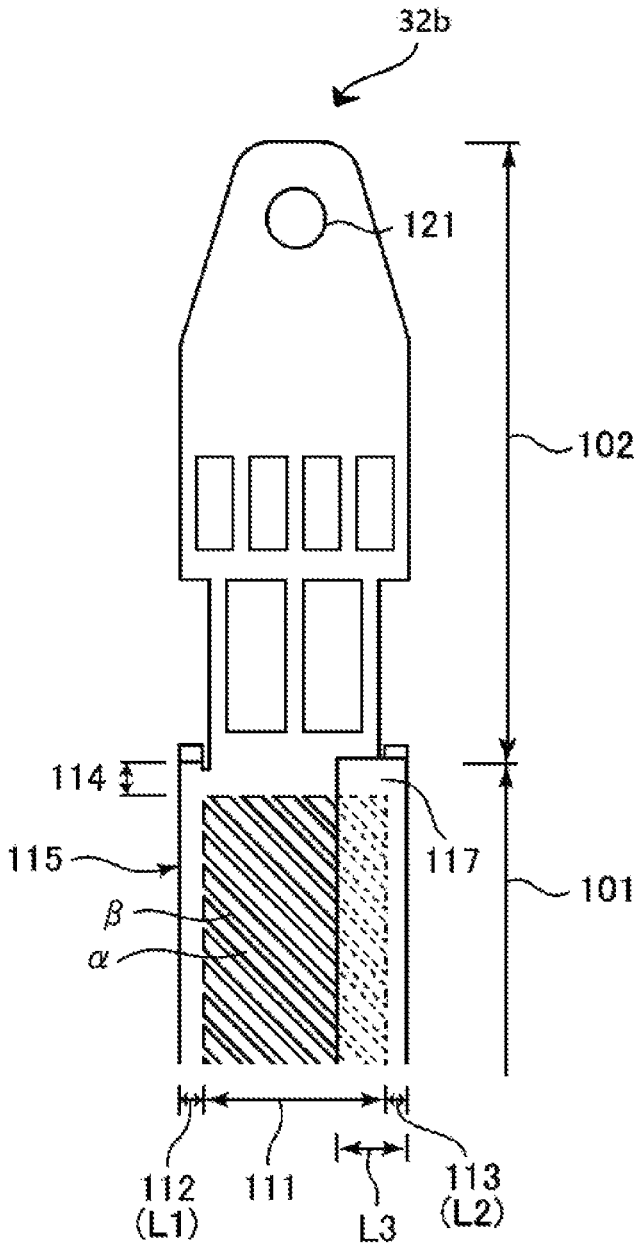

FIG. 8 is a top view of one of the lengthwise end portions of another example of a grid electrode, as seen from the direction which is perpendicular to the peripheral surface of the photosensitive member.

DESCRIPTION OF THE EMBODIMENTS

Hereinafter, the present invention is described in detail with reference to appended drawings of an image forming apparatus 100 in accordance with the present invention.

Embodiment 1

1. Overall Structure and Operation of Image Forming Apparatus

Figure 1:
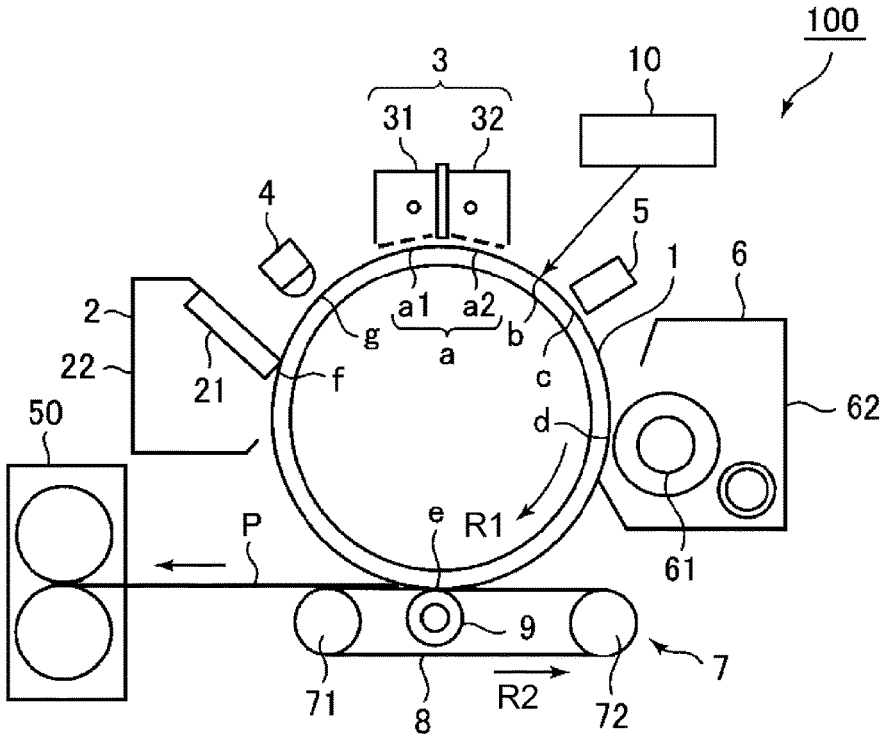
FIG. 1 is a schematic sectional view of a typical image forming apparatus to which the present invention is applicable.

FIG. 1 is a schematic sectional view of the image forming apparatus 100 in this embodiment (at plane which is roughly perpendicular to rotational axis of photosensitive drum 1, which will be described later). The image forming apparatus 100 in this embodiment is a laser beam printer which uses an electrophotographic image forming method.

The image forming apparatus 100 has the photosensitive drum 1 as a rotatable image bearing member, which is an electrophotographic photosensitive member and which is in the form of a drum (cylindrical). The photosensitive drum 1 is rotationally driven in the direction indicated by an arrow mark R1 in the drawing. The image forming apparatus 100 has also the following devices, which are disposed in the adjacencies of the peripheral surface of the photosensitive drum 1, in the order in which they will be listed in terms of the rotational direction of the photosensitive drum 1. The first one is a charging apparatus 3 as a charging means. The next one is an exposing apparatus 10 (laser scanner) as an exposing means. The next one is a potential level sensor 5 as a means for detecting surface potential level of the photosensitive drum 1. The next one is a developing apparatus 6 as a developing means. The next one is a transferring apparatus 7 as a transferring means which employs a transfer belt 8. The next one is a cleaning apparatus 2 as a cleaning means. The last one is an optical discharging device 4 as a discharging means.

The transferring apparatus 7 has the transfer belt 8, as a recording medium conveying member, which is a rotatable endless belt. The transfer belt 8 is disposed so that it opposes the peripheral surface of the photosensitive drum 1. It is supported by a pair of belt supporting rollers, more specifically, a driver roller 71 and an idler roller 72. As the driver roller 71 is rotationally driven, driving force is transmitted from the driver roller 71 to the transfer belt 8. Thus, the transfer belt 8 rotates (circularly moves) in the direction indicated by an arrow mark R2 in the drawing. The transferring apparatus 7 is also provided with a transfer roller 9, as a transferring member, which is on the inward side of the loop (belt loop) which the transfer belt 8 forms. The transfer roller 9 is positioned so that it opposes the photosensitive drum 1, with the presence of the transfer belt 8 between the transfer roller 9 and photosensitive drum 1, being pressed toward the photosensitive drum 1. Thus, a transferring position e (transferring portion) is formed in which the photosensitive drum 1 and transfer belt 8 are in contact with each other.

On the downstream side of the transferring position e in terms of the direction in which a sheet P of recording medium is conveyed, a fixing apparatus 50, which uses a combination of heat and pressure to fix an image, is disposed as a fixing means.

In an image forming operation, the photosensitive drum 1 is rotated. As the photosensitive drum 1 is rotated, the peripheral surface of the photosensitive drum 1 is uniformly charged to a preset polarity (negative, in this embodiment) and preset potential level by the charging apparatus 3. While the peripheral surface of the photosensitive drum 1 is charged by the charging apparatus 3, a preset amount of voltage is applied to the charging apparatus 3 from charging voltage power sources S1, S2, S4 and S5 (FIG. 2) as voltage applying means.

In this embodiment, the charging apparatus 3 is made up of an upstream charging device 31, in terms of the rotational direction of the photosensitive drum 1 (direction in which its peripheral surface moves), and a downstream charging device 32. In terms of the rotational direction of the photosensitive drum 1, a position in which a given portion of the peripheral surface of the photosensitive drum 1 is charged by the charging apparatus 3 is referred to as a charging position a. More specifically, in terms of the rotational direction of the photosensitive drum 1, a position in which a given point of the peripheral surface of the photosensitive drum 1 is charged by the upstream charging device 31 is referred to as an upstream charging position a1, whereas a position in which a given point of the peripheral surface of the photosensitive drum 1 is charged by the downstream charging device 32 is referred to as a downstream charging position a2. The charging apparatus 3 and voltage (charge voltage, charge bias) to be applied to the charging apparatus 3 are described later in detail.

The charged peripheral surface of the photosensitive drum 1 is scanned by (exposed to) a beam of laser light emitted by the exposing apparatus 10 while being modulated according to the information of the image to be formed. As a result, an electrostatic latent image (electrostatic image) which reflects the information of the image to be formed, is formed on the peripheral surface of the photosensitive drum 1. In terms of the rotational direction of the photosensitive drum 1, a position in which a given point on the peripheral surface of the photosensitive drum 1 is scanned by (exposed to) the beam of laser light emitted by the exposing apparatus 10 is referred to as an exposing position b.

The electrostatic latent image formed on the peripheral surface of the photosensitive drum 1 is developed into a visible image by a developing apparatus 6, which uses toner as developer. The developing apparatus 6 has a development roller 61 as a developer bearing member. The development roller 61 bears the toner in a developer container 62 in which toner is stored. It supplies the toner to the peripheral surface of the photosensitive drum 1 in the pattern of the electrostatic latent image. In this embodiment, an electrostatic latent image is developed in reverse. That is, toner is adhered to exposed points (areas) of the peripheral surface of the photosensitive drum 1 to form a toner image. More specifically, as a given point of the peripheral surface of the photosensitive drum 1 is exposed after it is charged, it reduces in potential in terms of absolute value. It is to this point that toner, charged to the same polarity as the polarity to which the peripheral surface of the peripheral surface of the photosensitive drum 1 is uniformly charged, adheres. During a developing operation, a preset amount of development voltage (development bias) is applied to the development roller 61 from an unshown development voltage (development bias) power source. In terms of the rotational direction of the photosensitive drum 1, a position (in which peripheral surface of development roller 61 opposes peripheral surface of photosensitive drum 1) in which a given point of the peripheral surface of the photosensitive drum 1 is supplied with toner from the development roller 61 is referred to as a developing position d.

The toner image formed on the peripheral surface of the photosensitive drum 1 is electrostatically transferred onto a sheet P of recording medium such as recording paper while the sheet P is conveyed by the transfer belt 8, remaining pinched between the photosensitive drum 1 and transfer belt 8. While the sheet P is conveyed, remaining pinched between the photosensitive drum 1 and transfer belt 8, a transfer voltage (transfer bias), which is DC voltage, is applied to the transfer roller 9 from an unshown transfer voltage power source. The polarity of the transfer voltage is opposite from the polarity (normal polarity of toner) to which toner is charged for development. In terms of the rotational direction of the photosensitive drum 1, a position (area of contact between photosensitive drum 1 and transfer belt 8) in which a toner image is transferred from the photosensitive drum 1 onto the sheet P is the transferring position e.

After the transfer of a toner image onto a sheet P of recording medium, the sheet P is separated from the transfer belt 8, and is conveyed to the fixing apparatus 50. The fixing apparatus 50 conveys the sheet P through itself while applying heat and pressure to the sheet P. Consequently, the toner image on the sheet P becomes fixed to the sheet P. Thereafter, the sheet P is discharged out of the main assembly of the image forming apparatus 100.

The toner (transfer residual toner) remaining on the peripheral surface of the photosensitive drum 1 after the transfer of the toner image onto a sheet P of recording medium is removed from the photosensitive drum 1 and recovered by the cleaning apparatus 2. The cleaning apparatus 2 is provided with a cleaning blade 21, as a cleaning member, which is disposed in contact with the peripheral surface of the photosensitive drum 1. It is also provided with a recovery container 22. As the photosensitive drum 1 is rotated, the cleaning apparatus 2 scrapes away the transfer residual toner from the peripheral surface of the photosensitive drum 1, with the use of its cleaning blade 21, and recovers the removed toner into its recovery container 22. In terms of the rotational direction of the photosensitive drum 1, a position in which the cleaning blade 21 is in contact with the peripheral surface of the photosensitive drum 1 is referred to as cleaning position f.

After the peripheral surface of the photosensitive drum 1 is cleaned by the cleaning apparatus 2, the peripheral surface of the photosensitive drum 1 is illuminated by the light (discharge light) emitted by the optical discharging device 4 to remove the residual charge from the peripheral surface of the photosensitive drum 1. Then, the peripheral surface of the photosensitive drum 1 is charged again by the charging apparatus 3. In terms of the rotational direction of the photosensitive drum 1, a position in which a given point of the peripheral surface of the photosensitive drum 1 is illuminated by the light from the optical discharging device 4 is referred to as a discharging position g.

In an operation to adjust the charge voltage, the potential level sensor 5 detects the potential level of the peripheral surface of the photosensitive drum 1. In order to enable the potential level sensor 5 to squarely face the peripheral surface of the photosensitive drum 1, so that it can detect the amount (level) of the surface potential of the photosensitive drum 1, within a preset range, in terms of the direction (lengthwise direction) parallel to the axial line of the photosensitive drum 1, in which an image can be formed on the peripheral surface of the photosensitive drum 1. In this embodiment, the potential level sensor 5 detects the surface potential level of the photosensitive drum 1, between the charging position a (in particular, downstream charging position a2) and developing position d (more precisely, between exposing position b and development position d), in terms of the rotational direction of the photosensitive drum 1. Also in terms of the rotational direction of the photosensitive drum 1, a position in which the surface potential level of a given point of the peripheral surface of the photosensitive drum 1 is detected by the potential level sensor 5 is referred to as a potential level detecting position c.

By the way, in this embodiment, the wavelength of light emitted by the exposing apparatus 10 is 675 nm. Also in this embodiment, the amount by which the peripheral surface of the photosensitive drum 1 is exposed by the exposing apparatus 10 can be changed within a range of 0.1-0.5 $\mu J/cm^2$. In this embodiment, it was set to 0.4 $\mu J/cm^2$.

2. Photosensitive Drum

The photosensitive drum 1 is rotatably supported by the main assembly of the image forming apparatus 100. The photosensitive drum 1 is a cylindrical photosensitive member. It is made up of an electrically conductive substrate and a photoconductive layer (photosensitive layer). The substrate is formed of aluminum or the like. The photoconductive layer is formed on the peripheral surface of the substrate in a manner to envelop the substrate. The photosensitive drum 1 is rotationally driven by a driving means (unshown) in the direction indicated by the arrow mark R1 in the drawing.

In this embodiment, the photosensitive drum 1 is chargeable to the negative polarity. It is a photosensitive member formed of amorphous silicon. It is 84 mm in external diameter. Also in this embodiment, the photosensitive layer of the photosensitive drum 1 is 40 μm in thickness, and 10 in dielectric constant. Further, the peripheral velocity of the photosensitive drum 1 is 700 mm/s. By the way, a substance other than amorphous silicon may be used as the material for the photosensitive layer of the photosensitive drum 1. For example, OPC (organic photosensitive substance) or the like may be used as the material for the photosensitive layer.

3. Structure of Charging Apparatus

Figure 2:
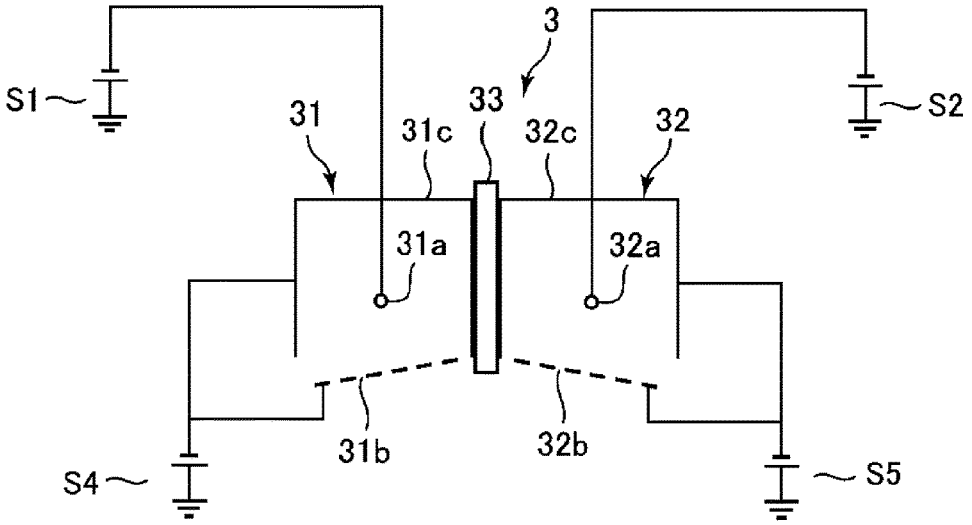
FIG. 2 is a schematic sectional view of a charging apparatus to which the present invention relates.

FIG. 2 is a schematic sectional view (at a plane which is roughly perpendicular to rotational axis of the photosensitive drum 1) of the charging apparatus 3 in this embodiment. The charging apparatus 3 is made up of a pair of corona-based charging devices, more specifically, the upstream charging device 31 and the downstream charging device 32 (Scorotron charging devices). In terms of the rotational direction of the photosensitive drum 1, the upstream and downstream charging devices 31 and 32 are positioned in the listed order. The upstream and downstream charging devices 31 and 32 are roughly the same in structure. That is, the upstream and downstream charging devices 31 and 32 have discharge wires 31*a* and 32*a*, grid electrodes 31*b* and 32*b*, and shields 31*c* and 32*c* (casing, shield electrodes), respectively. By the way, various elements of the upstream charging device 31, and those of the downstream charging device 32, and various parameters related thereto, may be differentiated by the addition of adjectives "upstream" or "downstream".

Each of the discharge wires 31*a* and 32*a* is an electrically conductive straight member (piece of electrically conductive straight wire). It is disposed so that it extends in the direction parallel (roughly parallel, in this embodiment) to the axial line of the photosensitive drum 1. In this embodiment, a piece of oxidized tungsten wire, which is 60 μm in diameter (external diameter), was used as each of the discharge wires 31*a* and 32*a*. In other words, a discharge wire used by an ordinary electrophotographic image forming apparatus was used.

Figure 3:
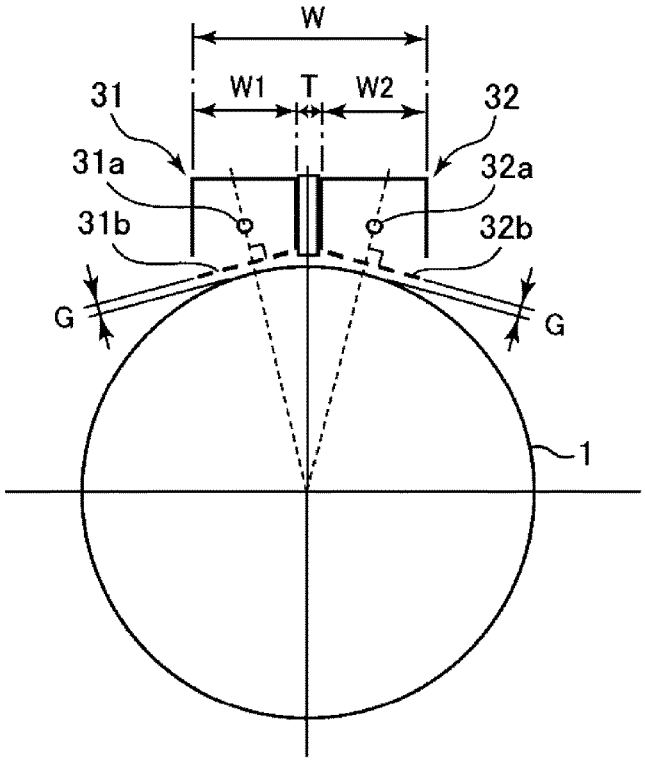
FIG. 3 is a schematic sectional view of a combination of a photosensitive member and a charging device; it is for describing the positioning of a grid electrode of the charging device.

As the material for each of the grid electrodes 31*b* and 32*b*, a piece of electrically conductive plate (flat plate) was used. It is disposed between the discharge wire 31*a* (32*a*) and the peripheral surface of the photosensitive drum 1, in parallel (roughly in parallel, in this embodiment) to the rotational axis of the photosensitive drum 1. Referring to FIG. 3, the upstream grid electrode 31*b* and downstream grid electrode 32*b* are made different in angle so that each of them squarely faces the peripheral surface of the photosensitive drum 1. With reference to a theoretical plane which is roughly perpendicular to the rotational axis of the photosensitive drum 1, the angle of each of the grid electrodes 31*b* and 32*b* is such that it is roughly perpendicular to the straight line which connects the discharge wire 31*a* (32*a*) and the rotational axis of the photosensitive drum 1. Further, each of the grid electrodes 31*b* and 32*b* is disposed so that the smallest gap G between it and the peripheral surface of the photosensitive drum 1 becomes 1.25±0.2 mm. Further, the opening ratio of the upstream grid electrode 31*b* is 90%, and the opening ratio of the downstream grid electrode 32*b* is 80%. Each of the upstream grid electrode 31*b* and downstream grid electrode 32*b* is such a grid electrode that was made by providing a piece of electrically conductive plate with multiple openings by etching. By the way, the definition of "opening ratio" of a grid electrode is the ratio of a sum, in terms of size, all of the openings of the charging portion of the grid electrode to the entire area of the charging portion. Each of the grid electrodes 31*b* and 32*b* was made of a piece of SUS (stainless steel) plate provided with multiple openings formed by etching. It is plated with nickel or the like to prevent corrosion.

The shields 31*c* and 32*c* are shaped to surround the discharge wires 31*a* and 32*a*, respectively. They are open on the side which faces the photosensitive drum 1. Each of the shields 31*c* and 32*c* is an electrically conductive boxy member. The grid electrodes 31*b* and 32*b* are disposed at the openings of the shields 31*c* and 32*c*, that is, the photosensitive drum side of the shields 31*c* and 32*c*, respectively.

Further, there is disposed a dielectric member 33 between the upstream charging device 31 and downstream charging device 32, in order to prevent the problem that when the bias applied to the upstream shield 31*c* is different from the bias applied to the downstream shield 32*c*, leak occurs. In this embodiment, a piece of plate made of electrically insulative substance is used as the dielectric member 33. Its thickness T is roughly 2 mm (in terms of direction parallel to line tangential to peripheral surface of photosensitive drum 1).

The width W (in terms of direction parallel to line tangential to peripheral surface of photosensitive drum 1 in FIG. 3) of the charging apparatus 3 is 42 mm. The length of the discharge area (in terms of direction parallel to axial line of photosensitive drum 1) is 340 mm. Further, the widths W1 and W2 (in terms of a direction parallel to a line tangential to a peripheral surface of photosensitive drum 1) of the upstream charging device 31 and downstream charging device 32 are 20 mm and 20 mm, respectively (they are the same).

4. Structural Arrangement for Applying Voltage to Charging Apparatus

Referring to FIG. 2, the upstream discharge wire 31*a* and downstream discharge wire 32*a* are in connection to the upstream charging voltage power source S1 and downstream charging voltage power source S2, respectively, each of which is a DC power source (high voltage power source). Thus, the voltage to be applied to the discharge wires 31*a* and the voltage to be applied to the discharge wire 32*a* can be independently controlled from each other.

Further, the upstream grid electrode 31*b* and downstream grid electrode 32*b* are in connection to the upstream charging voltage power source S4 and downstream charging voltage power source S5, respectively, each of which is also a DC power source. Thus, the voltage to be applied to the upstream grid electrode 31*b* and the voltage to be applied to the downstream grid electrode 32*b* can be independently controlled from each other. Further, the upstream shield 31*c* and downstream shield 32*c* are in connection to the upstream grid electrode 31*b* and downstream grid electrode 32*b*, respectively. In this embodiment, therefore, the shield 31*c* of the upstream charging device 31 and the shield 32*c* of the downstream charging device 32 are the same in potential, and the grid electrode 31*b* of the upstream charging device 31 and the grid electrode 32*b* of the downstream charging device 32 are the same in potential level. However, the shields 31*c* and 32*c* do not need to be the same in potential level as the grid electrodes 31*b* and 32*b*, respectively, and may be connected to a ground electrode of the main assembly of the image forming apparatus 100 to be grounded. All that is necessary here is that the voltage to be applied to the upstream charging device 31 and the voltage to be applied to the downstream charging device 32 can be independently controlled from each other, and the voltage to be applied to the discharge wire 31*a* and 32*a* of the upstream and downstream charging devices 31 and 32 can be independently controlled from the voltage to be applied to the grid electrodes 31*b* and 32*b* of the upstream charging device 31 and downstream charging device 32, respectively.

In this embodiment, the DC voltage to be applied to the discharge wires 31*a* and 32*a* is controlled so that the amount by which current is flowed by the voltage remains stable; it is allowed to vary within a range of 0--3200 μA. Further, the DC voltage to be applied to the grid electrodes 31*b* and 32*b* is controlled so that it remains stable, although it is allowed to fluctuate within a range of 0--1200 V. The voltages to be applied to the discharge wires 31*a* and 32*a* and the voltage to be applied to the grid electrodes 31*b* and 32*b* are controlled by one of the known potential controlling methods so that the voltages remain at preset levels.

In this embodiment, the charging apparatus 3 charges the photosensitive drum 1 by a combination of its upstream charging device 31 and downstream charging device 32; the combination yields the final potential level. In this embodiment, it is the one which is closer to the exposing position b than the upstream charging device 31, in terms of the rotational direction of the photosensitive drum 1, that determines the final potential level to which the photosensitive drum 1 is charged. Thus, the downstream charging device 32 is described in greater detail than the upstream charging device 31. By the way, the adjective "upstream" which indicates the positioning of the two charging devices 31 and 32 relative to each other in terms of the rotational direction of the photosensitive drum 1 may be eliminated unless its presence is required. Further, "upstream" and "downstream" mean the upstream and downstream sides, respectively, in terms of the rotational direction of the photosensitive drum 1.

5. Downstream Charging Device

Figure 4:
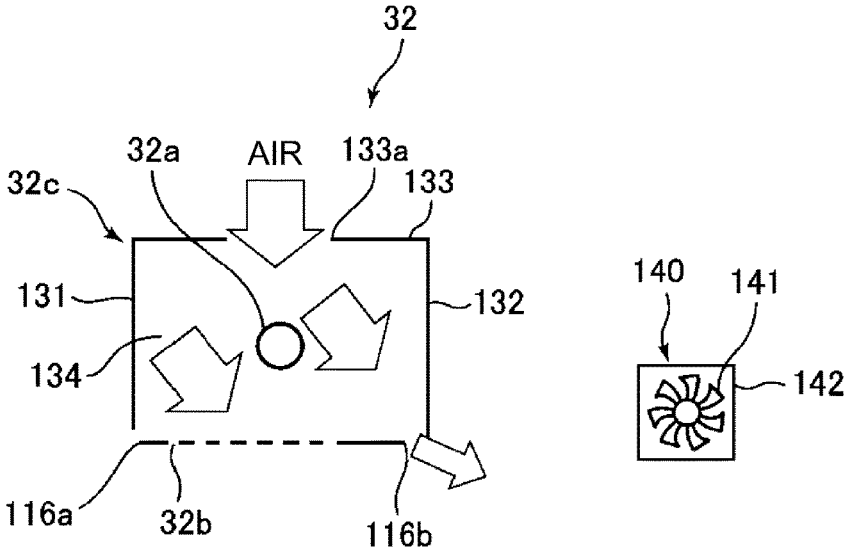
FIG. 4 is a schematic sectional view of a downstream charging device.

FIG. 4 is a schematic sectional view (at a plane which is roughly perpendicular to the rotational axis of photosensitive drum 1) of the charging device 32. As described above, the charging device 32 is made up of the discharge wire 32*a*, grid electrode 32*b*, and shield 32*c*. The shield 32*c* has a pair of vertical walls 131 and 132, and a horizontal wall 133. The vertical walls 131 and 132 are disposed on the upstream and downstream sides of the discharge wire 32*a*, roughly in parallel to each other. The horizontal wall 133 is disposed in a manner to connect the pair of vertical walls 131 and 132 to each other. Each of the pair of vertical walls 131 and 132 is roughly rectangular, having preset dimensions in terms of its lengthwise direction, which is roughly parallel to the axial line of the photosensitive drum 1, and its widthwise direction, which is roughly perpendicular to the lengthwise direction. The horizontal wall 133 also is rectangular, having preset dimensions in terms of its lengthwise direction, which is roughly parallel to the rotational axis of the photosensitive drum 1, and its widthwise direction, which is roughly perpendicular to the lengthwise direction.

The two vertical walls 131 and 132 of the shield 32*c* are connected to each other by the horizontal wall 133 of the shield 32*c* at their opposite edges from the photosensitive drum 1 (at their top edges), whereas the photosensitive drum 1 side of the shield 32*c* is open. It is roughly between the bottom edges (photosensitive drum side edges) of the two vertical walls 131 and 132 that the grid electrode 32*b* is disposed. The grid electrode 32*b* is a long and narrow member. It has preset dimensions in terms of both its widthwise direction, which is roughly perpendicular to the axial line of the photosensitive drum 1, and the direction which is roughly perpendicular to the widthwise direction. The horizontal wall 133 is provided with an opening 133*a*, through which an internal space 134, in which the discharge wire 32*a* is disposed, is in connection to the outside of the shield 32*c*.

The lengthwise end portions (front and back sides of sheet of paper on which FIG. 4 is printed) are provided with end members (unshown) having portions to which the discharge wire 32*a* and grid wire 32*b* are fixed.

In this embodiment, a gap is provided at least between a downstream edge portion 116*b* (in terms of widthwise direction of grid electrode 32*b*), and the shield 32*c*. To describe in greater detail, in this embodiment, the width of the grid electrode 32*b* is less than the distance between the inward surface (discharge wire side surface) of the vertical wall 131 of the shield 32*c* and that of the vertical wall 132. Further, the grid electrode 32*b* is disposed closer to the photosensitive drum 1 than the bottom edge of each of the two vertical walls 131 and 132 of the shield 32*c*. Therefore, there is a gap between an upstream edge portion 116*a* of the grid electrode 32*b* and the bottom edge of the shield 32*c*, and between the downstream edge portion 116*b* of the grid electrode 32*b* and the shield 32*c*.

As shown schematically in FIG. 4, the image forming apparatus 100 is provided with an airflow generation mechanism 140, which is made up of a fan 141, a duct 142, etc., to generate airflow in the main assembly of the image forming apparatus 100. This airflow generation mechanism 140 is an example of a means for generating such an airflow that flows from the discharge wire side of the grid electrode 32*b* toward the image bearing member side of the grid electrode 32*b*. The white arrow in FIG. 4 shows the airflow in the adjacencies of the charging device 32. The external air of the shield 32*c* is drawn into the internal space 134 of the shield 32*c* by the airflow generated by the airflow generation mechanism 140, through the opening 133*a* with which the horizontal wall 133 of the shield 32*c* is provided. The air drawn into the internal space 134 comes out of the shield 32*c* through the aforementioned gaps between the grid electrode 32*b* and shield 32*c*. When the air drawn into the shield 32*c* flows through the internal space 134 of the shield 32*c*, it is affected by the airflow generated by the rotation of the photosensitive drum 1. Thus, it goes out of the shield 32*c* mostly through the gap between the downstream bottom edge portion 116*b* of the grid electrode 32*b*, and the shield 32*c*. With the generation of this kind of airflow, the byproducts of the corona discharge are removed from within the charging device 32. Thus, the byproducts of the corona discharge do not linger in the charging device 32. Therefore, it does not occur that the byproducts of the corona discharge adhere to the peripheral surface of the photosensitive drum 1. Therefore, it does not occur that the peripheral surface of the photosensitive drum 1 is reduced in electrical resistance by the adhesions of the byproducts of the corona discharge to the photosensitive drum 1. Therefore, it does not occur that the peripheral surface of the photosensitive drum 1 fails to hold electrical charge due to the abovementioned reduction in electrical resistance. Therefore, it does not occur that the image forming apparatus 100 is made to output unsatisfactory images by the adhesion of the byproducts of the corona discharge to the peripheral surface of the photosensitive drum 1. As will be evident from the foregoing, in order to prevent ions from lingering in the charging device 32, it is important to provide a gap (gaps) between the downstream edge portion 116*b* of the grid electrode 32*b* in terms of the widthwise direction of the grid electrode 32*b* and the shield 32*c*, in consideration of the presence of the airflow generated by the rotation of the photosensitive drum 1.

The size and shape of this gap (gaps) between the grid electrode 32*b* (in particular, downstream edge portion 116*b* in terms of its widthwise direction) and the shield 32*c* are to be set to allow a proper amount of air to move out of the shield 32*c*. In this embodiment, the distance (shortest distance) between the upstream edge portion 116*a* of the grid electrode 32*b*, in terms of its widthwise direction and the shield 32*c*, and the distance (shortest distance) between the downstream edge portion 116*b* and the shield 32*c* were set to 3 mm.

By the way, the gap may be provided between the grid electrode 32*b* (in particular, downstream end portion 116*b*) and shield 32*c*, by making the width of the grid electrode 32*b* less than the distance between inward surface of the vertical wall 131 and that of the vertical wall 132, and positioning the grid electrode 32*b* between the inward surface of the vertical wall 131 and that of the vertical wall 132. Further, the gap may be provided between the grid electrode 32*b* (in particular, downstream edge portion) and shield 32*c*, by making the width of the grid electrode 32*b* greater than the distance between the inward surface of the vertical wall 131 and that of vertical wall 132, and positioning the grid electrode 32*b* closer to the photosensitive drum 1 than the bottom edges of the vertical walls 131 and 132.

6. Grid Electrode of Downstream Charging Device

Figure 5:
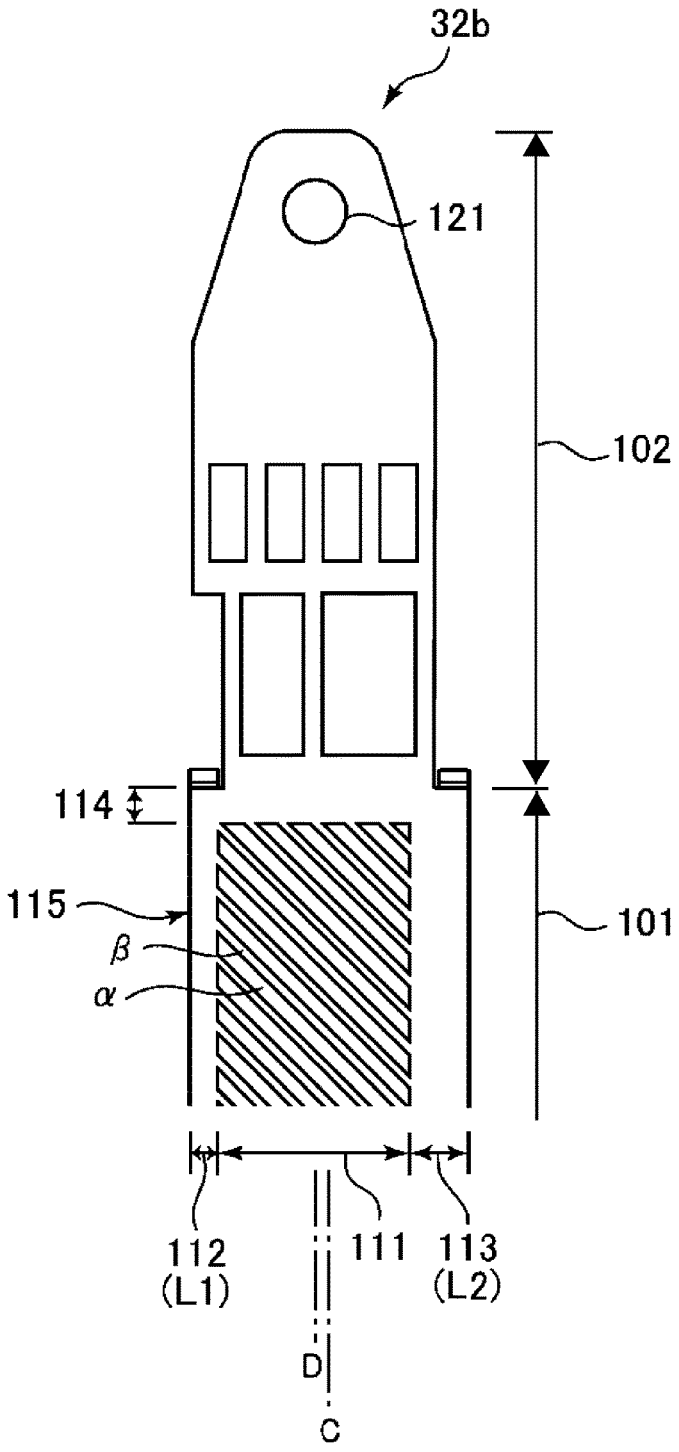
FIG. 5 is a top view of one of the lengthwise end portions of the grid electrode of the charging device, as seen from the direction which is perpendicular to the axial line of the photosensitive member of the image forming apparatus.

FIG. 5 is a top view of the grid electrode 32*b* in this embodiment. The grid electrode 32*b* has the same length as the photosensitive drum 1 in terms of the direction parallel to the rotational axis of the photosensitive drum 1. It has a main portion 101, which opposes the photosensitive drum 1, and a pair of appendant portions 102 (FIG. 5 shows only one of them), which extend from the lengthwise ends of the main portion 101, to be used for fixing the grid electrode 32*b* to a pair of end members, with which the lengthwise end portions of the shield 32*c* are provided one for one. Each of the appendant portions 102 of the grid electrode 32*b* is provided with a grid electrode fixation hole 121, through which a screw, a rivet, or the like is put to fix the grid electrode 32*b* to the end members. The main portion 101 has a charging portion 111, which has multiple openings α formed by etching (and non-opening (unetched) portions β) and a peripheral portion 115, which is not provided with any opening a (has not been subjected to an etching process). The charging portion 111 is roughly in the form of a long and narrow rectangle. Its long edges are parallel to the lengthwise direction of the grid electrode 32*b*. It is provided with multiple openings α formed by etching. The number of openings α is such that the opening ratio of the charging portion 111 becomes 80%. In other words, the charging portion 111 is in the form of a piece of mesh. The peripheral portion 115 surrounds the charging portion 111. That is, the peripheral portion 115 has an upstream peripheral portion 112, which is next to the upstream edge of the charging portion 111 in terms of the widthwise direction of the grid electrode 32*b*. Further, it has a downstream peripheral portion 113 which is next to the downstream edge of the charging portion 111 in terms of the widthwise direction of the grid electrode 32*b*. Further, the peripheral portion 115 has a pair of lengthwise end peripheral portions 114 (only one is shown), which are next to the lengthwise ends of the charging portion 111 in terms of the lengthwise direction of the grid electrode 32*b*. Ions can move through the openings α, but cannot move through the non-opening portions β (opening-free portion). Therefore, the corona current (ion flow, charged particle flow, corona wind) moves through the openings α of the charging portion 111, reaches the photosensitive drum 1, and charges the photosensitive drum 1. On the other hand, the peripheral portion 115 is a non-opening portion (having no openings) of a piece of SUS plate. Therefore, it does not occur that the corona current reaches the photosensitive drum 1 through the peripheral portion 115.

Further, in this embodiment, the grid electrode 32*b* is structured so that not only does it charge the peripheral surface of the photosensitive drum 1 by its upstream portion, but also makes the surface potential level of the photosensitive drum 1 converge to a preset level by its downstream portion. More concretely, with reference to the center C of the grid electrode 32*b* in terms of the widthwise direction of the grid electrode 32*b*, the downstream portion of the grid electrode 32*b* is provided with more non-opening portions β than the upstream portion (the sum of non-opening portions β is greater than the sum of openings α). In other words, with reference to the center C of the grid electrode 32*b* in terms of the widthwise direction of the grid electrode 32*b*, the upstream portion of the grid electrode 32*b* is provided with more openings α than the downstream portion of the grid electrode 32*b* (greater in sum of openings α). By the way, the relationship between the upstream and downstream portions of the grid electrode 32*b* in terms of the sum of openings α concerns only the main portion 101 of the grid electrode 32*b*. To describe in greater detail, in this embodiment, the grid electrode 32*b* is structured so that in terms of its widthwise direction, the dimension L1 of its upstream peripheral portion 112 is greater than the dimension L2 of its downstream peripheral portion 113. By the way, it is rather difficult to etch a piece of SUS plate to the edges of the piece of plate in order to form the charging portion 111 (meshed portion). In this embodiment, therefore, the grid electrode 32*b* is provided with the upstream peripheral portion 112. However, it is not mandatory that the grid electrode 32*b* is provided with the upstream peripheral portion 112.

That is, the upstream peripheral portion 112 cannot charge the peripheral surface of the photosensitive drum 1. In this embodiment, therefore, the grid electrode 32*b* is structured to be as small as possible in the dimension L1. On the other hand, the grid electrode 32*b* is structured to be as large as possible in the dimension L2 (>L1) in order to make the surface potential level of the photosensitive drum 1 converge to a preset value, as will be described later. The dimension L2 of the downstream peripheral portion 113 can be set so that the downstream peripheral portion 113 can satisfactorily make the surface potential level of the photosensitive drum 1 converge to the preset value. However, in consideration of the size of the charging device 32 and the dimension (width) which the charging portion 111 requires, and also, from the standpoint of charging the peripheral surface of the photosensitive drum 1 as uniformly as possible, it is preferable to make the grid electrode 32*b* as large as possible in the dimension of the downstream peripheral portion 113.

As described above, in this embodiment, the grid electrode 32*b* is structured so that, with reference to its portion (area) having the openings α formed by etching, the downstream portion of its non-opening portion (area), that is, the portion provided with no opening a formed by etching, is greater in dimension, in terms of the widthwise direction of the grid electrode 32*b*, than the upstream portion. In other words, in this embodiment, the grid electrode 32*b* is structured so that in terms of its widthwise direction, its center C is offset from the center D of the charging portion 111 (center D of charging portion 111 is on the upstream side of center C of grid electrode 32*b*). Moreover, in this embodiment, the charging apparatus 3 is structured so that the discharge wire 32*a* roughly squarely opposes the center C of the grid electrode 32*b*. Therefore, the downstream peripheral portion 113 functions as a converging portion for making the potential level of the peripheral surface of the photosensitive drum 1 converge to a preset value.

By the way, in this embodiment, the downstream peripheral portion 113 was made greater in width than the upstream peripheral portion 112 so that, with reference to the center C of the grid electrode 32*b* in terms of the widthwise direction of the grid electrode 32*b*, the sum of the downstream non-opening portions β is greater than that of the upstream non-opening portions β. This embodiment, however, is not intended to limit the present invention in scope in terms of the structure of the charging apparatus 3. For example, the charging apparatus 3 may be structured so that, with reference to the center C of the grid electrode 32*b* in terms of its widthwise direction, the downstream portion of the charging portion 111 is less in opening ratio than the upstream portion of the charging portion 111, in order to make the downstream portion greater in the number of the non-opening portions β than the upstream portion. In such a case, the upstream peripheral portion 112 and downstream peripheral portion 113 may be roughly the same in width.

7. Effects

Next, the effects of the grid electrode 32*b* in this embodiment are described further.

FIG. 6 is a graph which shows the relationship between the potential level (vertical axis) of a given point of the peripheral surface of the photosensitive drum 1 and the distance (horizontal axis) of the given point from the charging position of the upstream charging device 31, right after the given point was charged by the downstream charging device 32. A position 0 (mm) is the mid point between the upstream charging device 31 and downstream charging device 32. That is, that a given point (position) has a positive value means that the point (position) is on the downstream side of the mid point in terms of the rotational direction of the photosensitive drum 1. Therefore, if a given point has a negative value, it means that the potential of this point is primarily attributable to the upstream charging device 31, whereas if a given point of the peripheral surface of the photosensitive drum 1 has a positive value, it means that the potential of this point is primarily attributable to the downstream charging device 32 (combination of surface potential provided by the upstream charging device 31 and that provided by downstream charging device 32). By the way, part (b) of FIG. 6 is an enlargement of a part of part (a) of FIG. 6. Further, the value of the surface potential level is such a theoretical value to which the potential level of a given point on the peripheral surface of the photosensitive drum 1 will have settled by the time the given point reaches the developing position d.

Next, the method used to obtain the results shown in FIG. 6 is described. The peripheral surface of the photosensitive drum 1 was covered with a piece of dielectric sheet, which has a rectangular opening (window), the dimension of which is 3 mm in terms of the rotational direction of the photosensitive drum 1, and 10 mm in terms of the direction parallel to the axial line of the photosensitive drum 1. Then, the area of the peripheral surface of the photosensitive drum 1, which corresponds in position to the opening of this piece of dielectric sheet, was charged by upstream charging device 31 and downstream charging device 32, and the amount by which current flowed to the photosensitive drum 1 was measured. Then, the amount of current was converted to potential level in consideration of the size of the opening, peripheral velocity of the photosensitive drum 1, and dielectric constant of the photosensitive drum 1, obtaining thereby FIG. 6 (graph).

It is evident from FIG. 6 that, in this embodiment, if the distance of a given point of the photosensitive drum 1 from the charging position is no less than 20, the surface potential level of the photosensitive drum 1 is stable. That is, it is evident that in this portion (area), the peripheral surface of the photosensitive drum 1 is uniform and stable in surface potential level. The reason for this phenomenon seems to be that if a given point of the peripheral surface of the photosensitive drum 1 is facing the downstream peripheral portion 113 (convergence portion) of the grid electrode 32*b*, the corona current from the discharge wire 32*a* does not reach the given point, and therefore, the given point of the peripheral surface of the photosensitive drum 1 is not charged. On the other hand, a given unexposed point of the peripheral surface of the photosensitive drum 1 is prevented from attenuating in potential level, by the potential of the grid electrode 32*b*. Therefore, the potential level of the given unexposed portion converges to the preset level while the given unexposed point passes the area in which the given unexposed point opposes the downstream peripheral portion 113 (convergence portion). In this embodiment, the target value for the potential level of the photosensitive drum 1 in the developing position d is −500 V. It is evident from FIG. 6 that in this embodiment, it was possible to make the potential level of the peripheral surface of the photosensitive drum 1 converge to roughly −500 V.

Shown also by FIG. 6 is the results of a case where the width of the downstream peripheral portion 113 of the grid electrode 32*b* was roughly the same as that of the upstream peripheral portion 112, that is, the width of the downstream peripheral portion 113 was made narrower (comparative example 1) than that in this embodiment. It is evident from FIG. 6 that in the case of the comparative example 1, the downstream peripheral portion 113 is narrower, and therefore, a given point of the peripheral surface of the photosensitive drum 1 continued to be charged until the given point finishes moving through the area where the given point faces the downstream charging device 32. Therefore, it does not occur that while the given point is moved through the area in which it faces the downstream charging device 32, its surface potential level converges. In this case, the surface potential level of a given point of the peripheral surface of the photosensitive drum 1 sometimes shows the effect of the nonuniformity in thickness of the photosensitive layer of the photosensitive drum 1, and/or the changes in the distance between the upstream charging device 31 and downstream charging device 32, for example, when the given point is in the developing position d. That is, it sometimes occurs that the peripheral surface of the photosensitive drum 1 becomes nonuniform in the potential level.

As described above, in this embodiment, the charging apparatus 3 is structured so that the upstream portion of the grid electrode 32*b* contributes to the charging performance of the charging apparatus 3, whereas the downstream portion of the grid electrode 32*b* contributes to the uniformity (accuracy) in the potential level of the peripheral surface of the photosensitive drum 1 when the given point is in the developing position d. Further, it is ensured that air flows out of the charging device 32 through the gap between the downstream edge portion 116*b* of the grid electrode 32*b* and the shield 32*c*. Therefore, it does not occur that the byproducts of the corona discharge cause the image forming apparatus 100 to output defective images.

Embodiment 2

Next, another embodiment of the present invention is described. The basic structure and operation of the image forming apparatus in this embodiment are the same as those of the image forming apparatus in the first embodiment. Therefore, the elements of the image forming apparatus, which are the same as, or correspond to, those of the image forming apparatus in the first embodiment are given the same referential codes as those given to the counterparts in the first embodiment, and are not described in detail.

In the first embodiment, attention was paid to such an effect of the downstream peripheral portion 113 (which causes potential level of photosensitive drum to converge) of the grid electrode 32*b* that causes the potential level of the photosensitive drum 1 to converge to a preset value. The downstream peripheral portion 113, however, has also an effect of blocking the corona current which flows from the charging device 32 toward the exposing position b. Because of this effect of the downstream peripheral portion 113, it is possible to prevent the problem that the peripheral surface of the photosensitive drum 1 continues to be charged by the charging device 32 even after it was charged in the charging position a by the charging device 32. Therefore, it is possible to prevent the problem that the exposed portion of the peripheral surface of the photosensitive drum 1 is disturbed in potential level by the corona current which flows from the charging device 32 toward the exposing position b. In this embodiment, the positional relationship between the downstream peripheral portion 113 of the grid electrode 32*b* and the exposing position b in which the peripheral surface of the image bearing member is exposed was taken into consideration to enhance the downstream peripheral portion 113 of the grid electrode 32*b* in the effect of preventing the problem that the exposed portion of the peripheral surface of the photosensitive drum 1 is disturbed in potential level by the corona current which flows toward the exposing position b from the charging device 32.

FIG. 7 is a schematic sectional view (at a plane which is roughly perpendicular to rotational axial line of photosensitive drum 1) of a combination of the charging device, and the portion of the photosensitive member, which is facing the charging device; it is for describing the positioning of the downstream peripheral portion 113 of the grid electrode 32*b*. Reference "z" in FIG. 7 stands for the downstream edge of the area in which the peripheral surface of the photosensitive drum 1 can be charged by the discharge wire 32*a*. Here, "area in which the peripheral surface of the photosensitive drum 1 can be charged by the discharge wire 32*a*" means the area in which the peripheral surface of the photosensitive drum 1 can be charged by the discharge wire 32*a* if the charging portion 111 of the grid electrode 32*b* is specifically positioned. In other words, it includes an area in which the peripheral surface of the photosensitive drum 1 cannot be charged because of the positioning of the discharge wire 32*a*. In this embodiment, the downstream edge z is a point at which a straight line which coincides with the discharge wire 32*a* is tangential to the peripheral surface of the photosensitive drum 1 on the downstream side of the charging device 32. By the way, a straight line which is coincident with the discharge wire 32*a* and tangential to the peripheral surface of the photosensitive drum 1 is present also on the upstream side of the charging device 32. Here, however, attention is paid to only the downstream side of the charging device 32. The portion of the peripheral surface of the photosensitive drum 1, which is on the upstream side of the downstream edge z of the area in which the peripheral surface of the photosensitive drum 1 can be charged by the discharge wire 32*a*, is an area in which the peripheral surface of the photosensitive drum 1 can be charged by the discharge wire 32*a*, whereas the downstream side of the point z is an area in which the peripheral surface of the photosensitive drum 1 cannot be charged by the discharge wire 32*a*.

From the standpoint of the uniformity of the peripheral surface of the photosensitive drum 1 in potential level, it is desired that the exposing position b is on the downstream side of the downstream edge z of the area in which the peripheral surface of the photosensitive drum 1 can be charged by the charging device 32. To describe in greater detail, in an operation to charge the photosensitive drum 1, the grid electrode 32*b* is kept roughly stable in potential level to roughly uniformly charge the peripheral surface of the photosensitive drum 1. Thus, if the peripheral surface of the photosensitive drum 1 continues to be charged after it is charged in the charging position a, the convergence effect of the potential of the grid electrode 32*b* is nullified or made insufficient. Therefore, the exposed portion of the peripheral surface of the photosensitive drum 1 is likely to become deviant in potential from the preset one. On the other hand, from the standpoint of reducing the image forming apparatus 100 in size, the distance between the charging device 32 and exposing position b is desired to be as small as possible. Thus, the image forming apparatus 100 in this embodiment is structured so that the exposing position b, in which the peripheral surface of the photosensitive drum 1 is exposed by the exposing apparatus 10, is on the upstream side of the downstream edge z of the area in which the peripheral surface of the photosensitive drum 1 can be charged by the charging device 32, as shown in FIG. 7.

In this embodiment, therefore, the downstream peripheral portion 113 (which causes the potential of peripheral surface of photosensitive drum 1 to converge), which was described in the foregoing, is utilized to limit in size the area in which the peripheral surface of the photosensitive drum 1 can be charged by the discharge wire 32*a*. More concretely, the grid electrode 32*b* is structured so that its downstream peripheral portion 113, which has only non-opening portion β, blocks the exposing position b and the portion of the peripheral surface of the photosensitive drum 1, which is on the downstream side of the exposing position b, from the discharge wire 32*a*. That is, referring to the sectional view (FIG. 7) at a plane which is roughly perpendicular to the rotational axis of the photosensitive drum 1, the grid electrode 32*b* is structured so that its downstream peripheral portion 113 blocks the exposing position b, and the portion of the peripheral surface of the photosensitive drum 1, which is on the downstream side of the exposing position b and can be charged by the discharge wire 32*a*, from the discharge wire 32*a*. To describe further, referring to a sectional view (FIG. 7) at a plane which is roughly perpendicular to the rotational axis of the photosensitive drum 1, a line A is such a straight line that coincides with the exposing position b and discharge wire 32*a*, and a line B is such a straight line that is tangential to the peripheral surface of the photosensitive drum 1, on the downstream side of the exposing position b, and coincides with the discharge wire 32*a* (that is, line B is such a line that is tangential to peripheral surface of photosensitive drum 1 at the aforementioned downstream edge z and coincides with discharge wire 32*a*). The grid electrode 32*b* is structured so that the portion of its downstream peripheral portion 113, which is between its intersection with the line A and its intersection with line B, is provided with nothing but non-opening portion β.

That is, in this embodiment, the grid electrode 32*b* is structured so that as the charging device 32 is seen from the discharge wire side, the portion of the peripheral surface of the photosensitive drum 1, which is between the exposing position b and the downstream edge z of the area in which the peripheral surface of the photosensitive drum 1 can be charged by the charging device 32, is entirely behind the downstream peripheral portion 113. Therefore, it hardly occurs that a given portion of the peripheral surface of the photosensitive drum 1 is charged after being exposed. Therefore, it rarely occurs that a given portion of the peripheral surface of the photosensitive drum 1 is disturbed in potential after it is exposed. Further, in this embodiment, it is ensured by the presence of a gap between the downstream edge portion 116*b* of the grid electrode 32*b* and the shield 32*c* that air flows out of the charging device 32, as in the case of the first embodiment. Therefore, it does not occur that the byproducts of the corona discharge linger in the charging device 32. Therefore, it does not occur that the byproducts of the corona discharge adhere to the photosensitive drum 1. Therefore, it does not occur that the image forming apparatus 100 is made to output unsatisfactory images by the byproducts of the corona discharge.

As described above, in this embodiment, the downstream peripheral portion 113 of the grid electrode 32*b* can more effectively block the corona current as the corona current flows from the charging device 32 toward the exposing position b, without interfering with the airflow in the charging device 32. Further, in this embodiment, the downstream peripheral portion 113 of the grid electrode 32*b* is enabled to cause the potential of a given point of the peripheral surface of the photosensitive drum 1 to converge to a preset level while the given point moves through the area between the exposing position b and the downstream edge z of the area in which the peripheral surface of the photosensitive drum 1 is chargeable by the downstream charging device 32. That is, if the peripheral surface of the photosensitive drum 1 is charged by the discharge wire 32*a* after it is exposed, it is likely to become disturbed in potential. In this embodiment, therefore, the downstream peripheral portion 113 is made to play only the role of causing the potential level of a given point of the peripheral surface of the photosensitive drum 1 to converge to a preset value, after the given point is charged.

As described above, not only can this embodiment ensure that the potential of the peripheral surface of the photosensitive drum 1 converges to a preset (desired) level, but also this embodiment can block the corona current as the corona current flows toward the exposing position b, without interfering with the airflow in the charging device 32. Thus, not only can this embodiment make it possible to reduce the image forming apparatus 100 in size, but also this embodiment can improve the image forming apparatus 100 in terms of the uniformity in potential of the peripheral surface of the photosensitive drum 1. Thus, this embodiment makes it possible for the image forming apparatus 100 to output desirable images.

Embodiment 3

Next, yet another embodiment of the present invention is described. The basic structure and operation of the image forming apparatus in this embodiment are the same as those of the image forming apparatus in the first embodiment. Thus, if any element of the image forming apparatus in this embodiment is the same in function and/or structure as the counterpart of the image forming apparatus in the first embodiment, it is given the same referential code as the one given to the counterpart, and is not described here.

FIG. 8 is a top view of the grid electrode 32*b* in this embodiment. The grid electrode 32*b* in this embodiment is roughly the same in structure as the one in the first embodiment. In this embodiment, however, the width L1 of the upstream peripheral portion 112 is roughly the same as the width L2 of the downstream peripheral portion 113. Further, in this embodiment, the grid electrode 32*b* is provided with an electrically conductive blocking member 117, which makes the portion of the charging portion 111, which is adjacent to the downstream edge of the charging portion 111, into a virtual opening-free portion β by covering up the portion.

That is, in this embodiment, the electrically conductive blocking member 117 is employed to create a portion which is similar to the downstream peripheral portion 113 in the first embodiment, which is for causing the potential of the peripheral surface of the photosensitive drum 1 to converge to a preset level. A typical substance which can be used as the electrically conductive material for the blocking member 117 is a metallic substance. The means for fixing the blocking member 117 to the main portion 101 of the grid electrode 32*b* may be optional. It may be bonding, welding, or bounding, for example. In this embodiment, a piece of aluminum sheet was used as the blocking member 117, and was pasted to the charging portion 111 to cover the downstream edge portion of the grid electrode 32*b*, which corresponds in position to the main portion 101 in terms of the lengthwise direction of the grid electrode 32*b*, in such a manner to cover the openings α in the downstream edge portion of the grid electrode 32*b*.

Also in this embodiment, the upstream peripheral portion 112 cannot charge the peripheral surface of the photosensitive drum 1 as it cannot in the first embodiment. Thus, its width L1 is desired to be as small as possible. On the other hand, the blocking member 117 is desired to be as great as possible in its width L3 (>L1) so that it can cause the potential of the peripheral surface of the photosensitive drum 1 to converge. With the grid electrode 32*b* being designed as described above, it is possible to improve the image forming apparatus 100 in the uniformity of the potential of the peripheral surface of the photosensitive drum 1.

By the way, the surface (portion of grid electrode 32*b*) to which the blocking member 117 is to be attached may be either the surface of the grid electrode 32*b*, which is on the photosensitive drum side or discharge wire side. In this embodiment, it was attached to the discharge wire side of the grid electrode 32*b*. Also in this embodiment, the blocking member 117 is attached to the grid electrode 32*b* so that it covers the portion of the grid electrode 32*b*, which includes the downstream end portion of the charging portion 111 and the downstream peripheral portion 113. However, the blocking member 117 may be attached to the charging portion 111 in such a manner that it covers the openings α in a predetermined area of the charging portion 111, which is on the immediately upstream side of the downstream edge of the charging portion 111. That is, the grid electrode 32*b* may be structured so that a combination of the blocking member 117 and downstream peripheral portion 113 makes up the aforementioned convergence portion. Further, the blocking member 117 may be positioned so that it partially covers the charging portion 111 and the downstream peripheral portion 113 in such a manner that the openings α in a predetermined portion of the charging portion 111 are left unblocked, as in the second embodiment. Attaching the blocking member 117 in such a manner can provide the effects similar to those obtained by the second embodiment.

As described above, not only can this embodiment provide effects similar to those obtainable by the first and second embodiments, but also, can make it possible to attach the blocking member 117 to the grid electrode 32*b*, and also, to vary the blocking member 117 in width. In other words, this embodiment makes it easier to change the charging device 32 (and/or image forming apparatus 100) in design.

[Miscellanies]

In the foregoing, the present invention was described with reference to a few of the preferred embodiments of the present invention. However, the preceding embodiments are not intended to limit the present invention in scope.

In the preceding embodiments, the image forming apparatuses were image forming apparatuses of the so-called dry-type. However, the present invention is also applicable to image forming apparatuses of the so-called wet-type. An image forming apparatus of the wet-type is different from the image forming apparatuses in the preceding embodiments, in that it uses liquid developer which is made up of toner, and liquid carrier in which toner is dispersed. In terms of the image formation process, however, the image formation process to be carried out by an image forming apparatus of the wet-type is roughly the same as that to be carried out by the image forming apparatuses in the preceding embodiments. A corona-based charging device can also be employed as the charging means for charging an image bearing member to form an electrostatic image on the image bearing means. Thus, the present invention can also be applied to the corona-based charging device, in order to obtain effects similar to those obtainable by the embodiments described above.

Further, in the embodiments described above, two corona-based charging devices were provided for a single image bearing member. However, the present invention is also applicable to an image forming apparatus structured so that only one corona-based charging device is provided per image bearing member. Such application of the present invention can provide effects similar to those provided by the image forming apparatus in the preceding embodiments. However, an attempt to reduce in size an image forming apparatus having a combination of a single image bearing member and a pair of charging devices is likely to reduce the distance between the corona-based charging device and the exposing position. Thus, the effects of the present invention are more remarkable in a case where the present invention is applied to an image forming apparatus having two corona-based charging devices per image bearing member than otherwise. In a case where two corona-based charging devices are provided per image bearing member, it is desired that the grid electrode of at least the most downstream corona-based charging device in terms of the rotational direction of the image bearing member is similarly structured to those in the embodiments described above. It is optional to similarly structure the grid electrode of the other corona-based charging devices to those in the embodiments described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-090615 filed on Apr. 28, 2017, which is hereby incorporated by reference herein in its entirety.

What is claimed is:

1. An image forming apparatus comprising:

a rotatable photosensitive member;

a corona charger including a discharging wire and a plate-like grid electrode and being configured to charge a surface of said photosensitive member at a charging position; and an exposure device configured to expose the surface of said photosensitive member charged by said corona charger at an exposure position, which is at a downstream side of said corona charger in a rotational direction of said photosensitive member at the charging position, to form an electrostatic image, wherein said grid electrode includes a first portion having a plurality of openings and a second portion provided adjacent to said first portion with respect to the rotational direction, said second portion including a downstream side peripheral portion not provided with an opening in a charging region in a longitudinal direction of said corona charger, and wherein in a cross-section orthogonal to the longitudinal direction and including the charging region, the downstream side peripheral portion extends from a downstream end portion of said plate-like grid electrode at least to a position crossing with a straight line A passing through the exposure position and said discharging wire.

2. An image forming apparatus according to claim 1, wherein said corona charger includes upstream and downstream shield portions sandwiching said discharging wire and being substantially perpendicular to said grid electrode, and a gap is provided in the cross-section between said downstream shield portion and a downstream side end portion of said downstream side peripheral portion with respect to the rotational direction.

3. An image forming apparatus according to claim 1, wherein said grid electrode includes an upstream side peripheral portion at an upstream end of said grid electrode with respect to the rotational direction, and a length of the downstream side peripheral portion measured in the rotational direction is longer than a length of the upstream side peripheral portion measured in the rotational direction.

4. An image forming apparatus according to claim 1, further comprising a fan capable of generating a flow of air in the direction from a discharging wire side surface of said grid electrode toward a photosensitive member side surface of said grid electrode.

5. An image forming apparatus according to claim 1, wherein the downstream side peripheral portion extends toward the downstream side at least to a tangential line B of said photosensitive member passing through said discharging wire at the downstream side in the rotational direction.

6. An image forming apparatus comprising:

a rotatable photosensitive member;

a corona charger including a discharging wire and upstream and downstream shield portions sandwiching said discharging wire, and being configured to charge a surface of said photosensitive member at a charging position;

an exposure device configured to expose the surface of said photosensitive member charged by said corona charger at an exposure position, which is at a downstream side of said corona charger in a rotational direction of said photosensitive member at the charging position, to form an electrostatic image; and a shielding member configured to shield said photosensitive member from said discharging wire, said shielding member extending from the downstream shield portion at least to a straight line A passing through the exposure position and said discharging wire in a cross-section orthogonal to the longitudinal direction and including a charging region.

7. An image forming apparatus according to claim 6, wherein a plate-like grid electrode is provided between said shielding member and said discharging wire.

* * * * *